US007114474B2

(12) United States Patent
Oshita et al.

(10) Patent No.: US 7,114,474 B2
(45) Date of Patent: Oct. 3, 2006

(54) TENSIONER LIFTER MOUNTING STRUCTURE FOR V-ENGINE

(75) Inventors: Toru Oshita, Saitama (JP); Toru Kisaichi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/303,906

(22) Filed: Dec. 19, 2005

(65) Prior Publication Data

US 2006/0130781 A1 Jun. 22, 2006

(30) Foreign Application Priority Data

Dec. 22, 2004 (JP) ..... 2004-370736

(51) Int. Cl.
*F01L 1/02* (2006.01)

(52) U.S. Cl. ..... 123/90.31; 123/90.27

(58) Field of Classification Search ..... 123/90.15, 123/90.16, 90.17, 90.18, 90.27, 90.31
See application file for complete search history.

(56) References Cited

U.S. PATENT DOCUMENTS 6,439,185 B1 * 8/2002 Tosaka et al. ..... 123/90.27

FOREIGN PATENT DOCUMENTS

JP 2000-199434 A 7/2000

* cited by examiner

*Primary Examiner*—Thomas Denion
*Assistant Examiner*—Ching Chang
(74) *Attorney, Agent, or Firm*—Birch, Stewart, Kolasch & Birch, LLP

(57) ABSTRACT

A chain tensioner is in sliding contact with each cam chains in a pair of banks and each of cylinder heads of the pair of banks includes a tensioner lifter that abuts on a corresponding one of the two chain tensioners from a side opposite to the cam chains. Of the two tensioner lifters, a first tensioner lifter is disposed on a cylinder head of a first bank at a portion corresponding to an outside of two banks. A second tensioner lifter is disposed on a cylinder head of a second bank at a portion corresponding to an inside of the two banks. A distance between an upper end connection surface of the cylinder head of the first bank and the tensioner lifter is set to be smaller than a distance between an upper end connection surface of the cylinder head of the second bank and the other tensioner lifter.

20 Claims, 11 Drawing Sheets

TENSIONER LIFTER MOUNTING STRUCTURE FOR V-ENGINE

CROSS-REFERENCE TO RELATED APPLICATIONS

The present application claims priority under 35 USC 119 to Japanese Patent Application No. 2004-370736 filed on Dec. 22, 2004 the entire contents of which are hereby incorporated by reference.

FIELD OF THE INVENTION

The present invention relates to a V-engine having an arrangement, in which cylinder heads of first and second banks are set at an angle to each other so as to form the letter V and are provided in a connected row arrangement on a crankcase that rotatably supports a crankshaft with a camshaft being rotatably supported on each of these two banks. A chain tensioner is provided so as to be in a sliding contact with each of cam chains that transmit power from the crankshaft to corresponding ones of the two camshafts. Each of the cylinder heads of the two banks includes a tensioner lifter that abuts on a corresponding one of the two chain tensioners from a side opposite to the cam chains so as to give tension to each of the cam chains.

More particularly, the present invention relates to an improved structure for mounting a tensioner lifter.

DESCRIPTION OF BACKGROUND ART

A V-engine is known as disclosed, for example, in Japanese Patent Laid-open No. 2000-199434. This V-engine has an arrangement, in which chain tensioners make a sliding contact with corresponding ones of a pair of cam chains for transmitting power to corresponding ones of the camshafts of a pair of banks set at an angle to form the letter V that are urged toward a side of the cam chains by tensioner lifters included in cylinder heads of the two banks.

The V-engine disclosed in Japanese Patent Laid-open No. 2000-199434 includes the following arrangements. More specifically, one tensioner lifter is disposed on the cylinder head of one bank at a portion corresponding to an outside of both banks. The other tensioner lifter is disposed on the cylinder head of the other bank at a portion corresponding to an inside of both banks. Each of the two tensioner lifter is disposed on the corresponding one of the cylinder heads at a position equally spaced away from an upper end connection surface of the corresponding one of the cylinder heads. In these arrangements, the tensioner lifter disposed on the cylinder head of the other bank at the portion corresponding to the inside of the two banks is located on a relatively higher level between the two banks. This results in a dead space occupying a relatively large ratio of a space between the two banks.

SUMMARY AND OBJECTS OF THE INVENTION

In view of the foregoing, it is an object of the present invention to provide a structure for mounting a tensioner lifter in a V-engine for helping to minimize as much as possible a dead space between a pair of banks.

To achieve the foregoing object, an embodiment of the present invention provides, in a V-engine having an arrangement, in which cylinder heads of first and second banks, set at an angle to each other so as to form the letter V, are provided in a connected row arrangement on a crankcase that rotatably supports a crankshaft with camshafts being rotatably supported on corresponding ones of the two banks. The V-engine further includes an arrangement, in which chain tensioners are provided so as to be in a sliding contact with a corresponding one of cam chains that transmit power from the crankshaft to corresponding ones of the camshafts, and the cylinder heads of the two banks include tensioner lifters that abut on a corresponding one of the two chain tensioners from a side opposite to the cam chains so as to give tension to each of the cam chains. A structure for mounting a tensioner lifter, includes one tensioner lifter of the two tensioner lifters that is disposed on the cylinder head of the first bank at a portion corresponding to an outside of the first and the second banks. The other tensioner lifter of the two tensioner lifters is disposed on the cylinder head of the second bank at a portion corresponding to the inside of the first and the second banks. A distance between an upper end connection surface of the cylinder head of the first bank and the one tensioner lifter is set to be smaller than a distance between an upper end connection surface of the cylinder head of the second bank and the other tensioner lifter.

An embodiment of the present invention provides a portion of the other tensioner lifter projecting from the cylinder head of the second bank that is disposed to be inclined so as to be closer to the upper end connection surface of the cylinder head toward an outward end.

An embodiment of the present invention provides a portion of the tensioner lifter projecting from the cylinder head of the first bank that is disposed to be inclined so as to be farther away from the upper end connection surface of the cylinder head toward an outward end.

According to an embodiment of the present invention, the tensioner lifter disposed on the cylinder head at the portion corresponding to the inside of the pair of banks is disposed at a level as low as possible, thereby allowing a dead space between the two banks to be minimized as much as possible.

According to an embodiment of the present invention, the dead space between the two banks can be made even smaller and mounting of the tensioner lifter disposed on the inside of the two banks onto the second cylinder head from above can be facilitated. Thus, the mountability is thereby enhanced.

According to an embodiment of the present invention, the portion of the tensioner lifter disposed on the outside of the two banks projecting from the cylinder head can be suppressed and the engine can be built even more compactly.

At the same time, a space for placing auxiliaries disposed around the engine can be secured.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A specific embodiment to which the present invention is applied will be described below with reference to the accompanying drawings.

Figure 1:
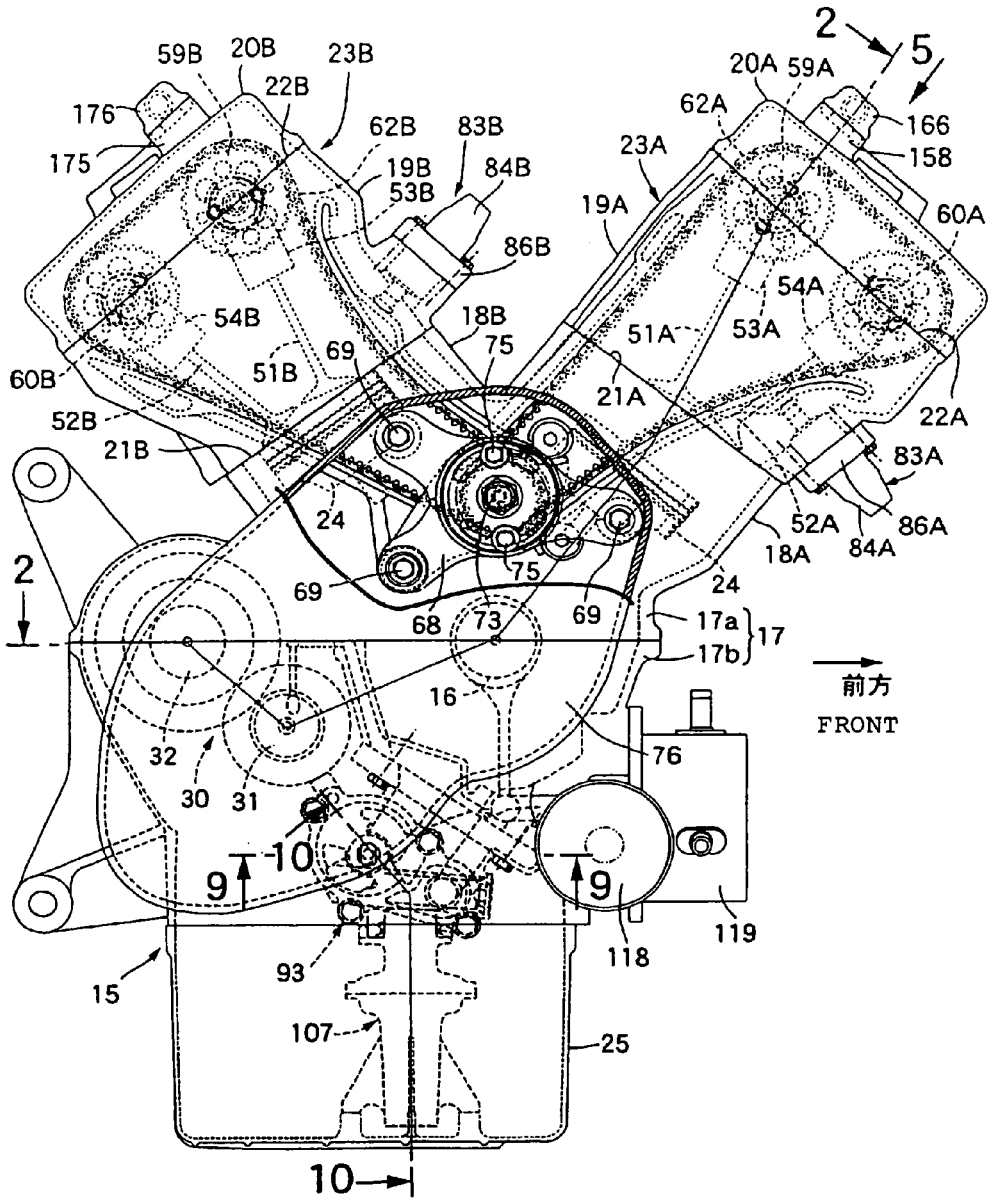
FIG. 1 is a partly cutaway side elevational view showing a V-engine.

Referring first to FIG. 1, a 5-cylinder V-engine, for example, is mounted on a vehicle, for example, a motorcycle. An engine main body 15 of the V-engine includes a crankcase 17, a first cylinder block 18A, a first cylinder head 19A, a first head cover 20A, a second cylinder block 18B, a second cylinder head 19B, and a second head cover 20B. The crankcase 17 rotatably supports a crankshaft 16 having an axis extending in a lateral direction of the motorcycle. The first cylinder block 18A is connected to the crankcase 17 on a forward side along a direction of travel of the motorcycle. The first cylinder head 19A is connected to an upper end connection surface 21A of the first cylinder block 18A. The first head cover 20A is connected to an upper end connection surface 22A of the first cylinder head 19A. The second cylinder block 18B is connected to the crankcase 17 on a rearward side along the direction of travel of the motorcycle. The second cylinder head 19B is connected to an upper end connection surface 21B of the second cylinder block 18B. The second head cover 20B is connected to an upper end connection surface 22B of the second cylinder head 19B.

The crankcase 17 includes an upper portion case 17*a* and a lower portion case 17*b*, both mutually connected together. The crankshaft 16 is rotatably supported between the upper portion case 17*a* and the lower portion case 17*b*. In addition, the first cylinder block 18A and the second cylinder block 18B are formed integrally with the upper portion case 17*a*.

Accordingly, the first cylinder block 18A, the first cylinder head 19A, and the first head cover 20A form a first bank 23A of three cylinders. Further, the second cylinder block 18B, the second cylinder head 19B, and the second head cover 20B form a second bank 23B of two cylinders that forms the letter V opening upwardly with the first bank 23A.

Figure 2:
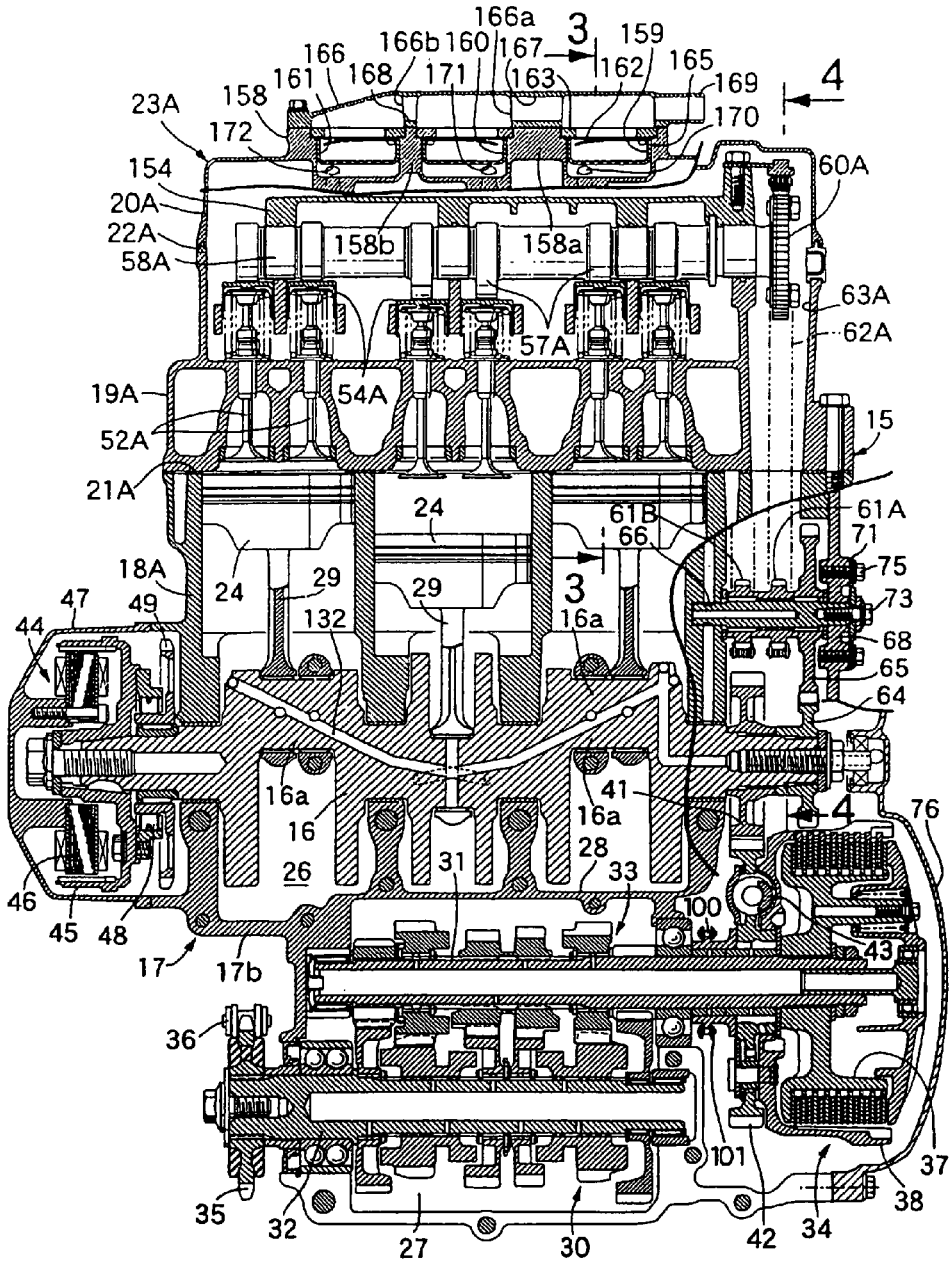
FIG. 2 is a cross-sectional view taken along line 2—2 of FIG. 1.

Referring also to FIG. 2, the first cylinder block 18A of the first bank 23A includes three pistons 24 arranged alongside of the axis of the crankshaft 16 and fitted slidably in position. The second cylinder block 18B of the second bank 23B includes two pistons 24 arranged alongside of the axis of the crankshaft 16 and fitted slidably in position. Each of the pistons 24 of the first and second banks 23A, 23B is commonly connected to a corresponding one of crankpins 16*a* the crankshaft 16 has via a corresponding one of connecting rods 29.

An oil pan 25 is connected to a lower portion of the crankcase 17, namely, a lower portion of the lower portion case 17*b*. The crankcase 17 includes a crank chamber 26 and a barrier rib 28. The crank chamber 26 accommodates a good part of the crankshaft 16. The barrier rib 28 marks off from a transmission chamber 27 formed by the crankcase 17 and the oil pan 25 so as to be located rearwardly and downwardly of the crank chamber 26.

A constant-mesh type gear transmission 30 is accommodated in the transmission chamber 27 rearward of the crank chamber 26. The gear transmission 30 includes a main shaft 31, a countershaft 32, and a gear train 33. The main shaft 31 has an axis running in parallel with the crankshaft 16 and is rotatably supported on the lower portion case 17*b* of the crankcase 17. The countershaft 32 has an axis running in parallel with the main shaft 31 and is rotatably supported between the upper portion case 17*a* and the lower portion case 17*b* of the crankcase 17. The gear train 33 is disposed between the main shaft 31 and the countershaft 32 to provide a plurality of speeds, for example, six speeds, by achieving a selective engagement. A power drive from the crankshaft 16 is applied to one end of the main shaft 31 via a clutch 34. A drive sprocket 35 is secured to an end of the countershaft 32 projecting from a left side wall of the crankcase 17 looking forward in the direction of travel of the motorcycle. An endless chain 36 for transmitting a power drive to a rear wheel not shown is wound around the drive sprocket 35.

The clutch 34 is a well-known multiple disk clutch. The clutch 34 includes a clutch inner 37 that disables relative rotation with the main shaft 31 and a clutch outer 38 that enables relative rotation with the main shaft 31.

One end of the crankshaft 16 projects from a right side wall of the crankcase 17 looking forward in the direction of travel of the motorcycle. A primary drive gear 41 having a relatively large diameter is secured onto the one end of the crankshaft 16 on an outside of the crankcase 17. A primary driven gear 42 to be in mesh with the primary drive gear 41 is connected to the clutch outer 38 of the clutch 34 via a damper spring 43.

The other end of the crankshaft 16 projects from a left side wall of the crankcase 17 looking forward in the direction of travel of the motorcycle. An outer rotor 45 of a generator 44 is secured to the other end of the crankshaft 16. Further, an inner stator 46 forming part of the generator 44 with the outer rotor 45 is secured to a generator cover 47 that is connected to the left side wall of the crankcase 17 so as to cover the generator 44. A gear 49 is connected to the outer rotor 45 via a one-way clutch 48. The gear 49 is operatively connected to a starter motor not shown.

Figure 3:
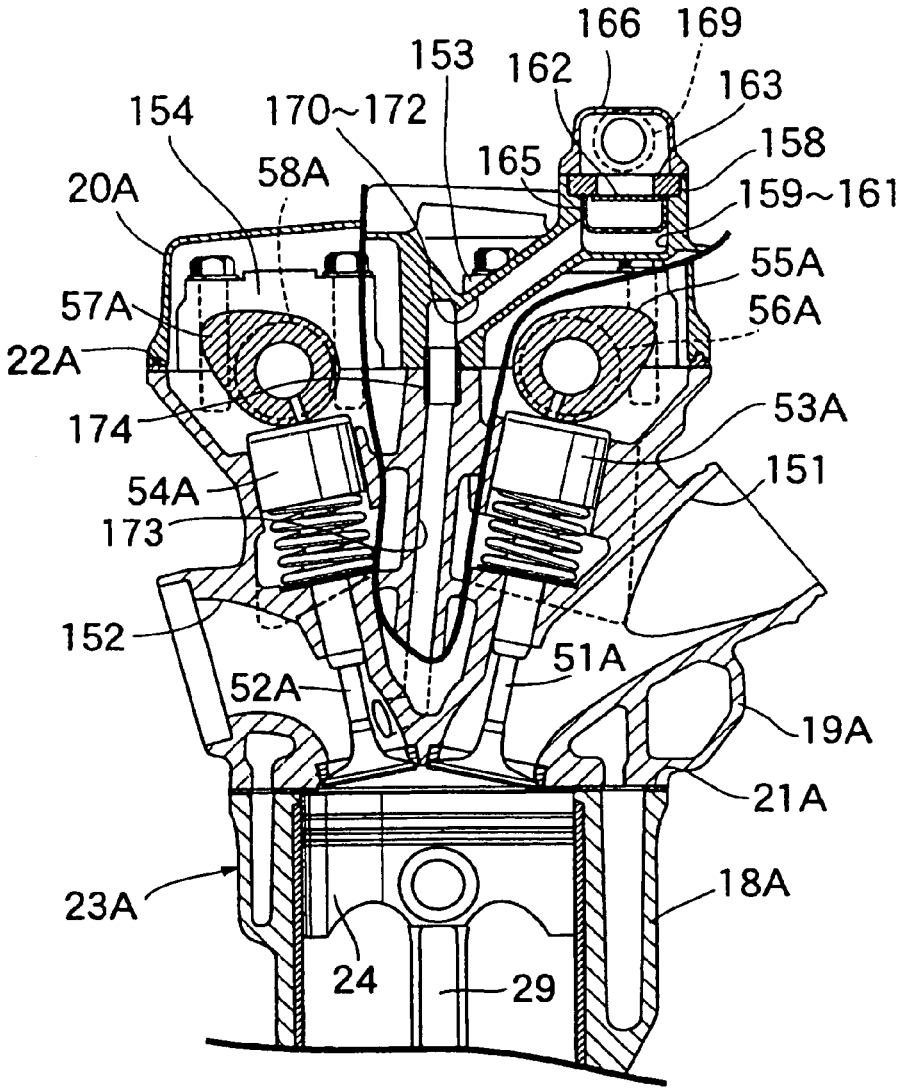
FIG. 3 is a cross-sectional view taken along line 3—3 of FIG. 2.

Referring to FIG. 3, in the first cylinder head 19A of the first bank 23A, each cylinder includes an intake port 151 and an exhaust port 152. The intake ports 151 open to face inwardly of both banks 23A, 23B. The exhaust ports 152 open to a side wall on an opposite side to the intake ports 151. A pair of intake valves 51A is provided for each of the intake ports 151. A pair of exhaust valves 52A is provided for each of the exhaust ports 152. The intake valves 51A and the exhaust valves 52A are disposed in the first cylinder head 19A by being capable of opening and closing, while being spring-urged in a valve closing direction. Further, an intake valve side lifter 53A and an exhaust valve side lifter 54A are fitted in the first cylinder head 19A. The intake valve side lifter 53A is a bottomed cylinder having an inner surface of a closed end thereof abutted against a head of each of the intake valves 51A. The exhaust valve side lifter 54A is also a bottomed cylinder having an inner surface of a closed end thereof abutted against a head of each of the exhaust valves 52A. The intake valve side lifters 53A and the exhaust valve side lifters 54A are fitted in the first cylinder head 19A so as to be slidable in the opening and closing directions of the intake valves 51A and the exhaust valves 52A.

In addition, the first cylinder head 19A and an intake side cam holder 153 joined thereto rotatably support an intake side camshaft 56A about an axis that runs in parallel with the crankshaft 16. The intake side camshaft 56A has a plurality of intake side cams 55A that make a sliding contact with outer surfaces of the closed ends of corresponding ones of the intake valve side lifters 53A. Similarly, the first cylinder head 19A and an exhaust side cam holder 154 joined thereto rotatably support an exhaust side camshaft 58A about an axis that runs in parallel with the crankshaft 16. The exhaust side camshaft 58A has a plurality of exhaust side cams 57A that make a sliding contact with outer surfaces of the closed ends of corresponding ones of the exhaust valve side lifters 54A.

Figure 4:
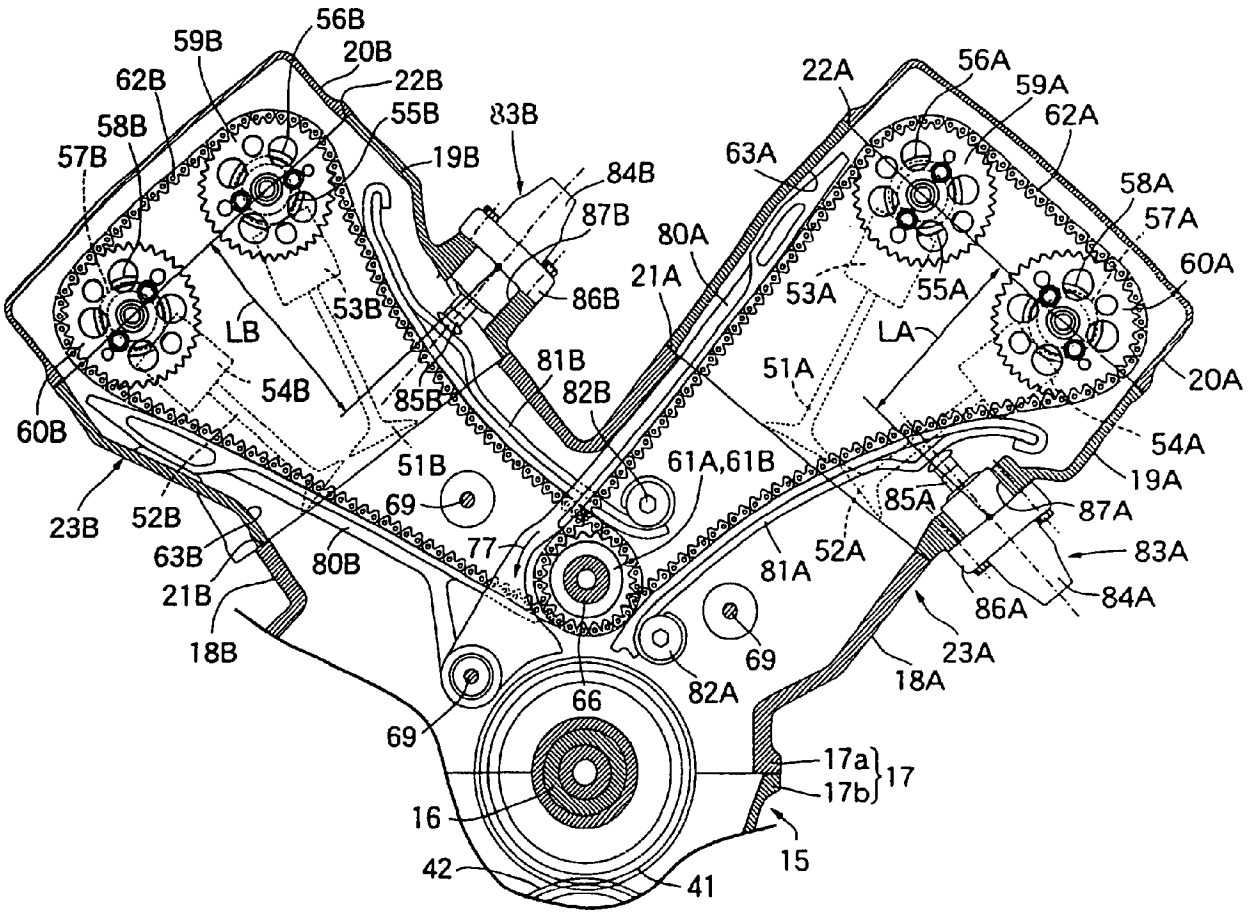
FIG. 4 is a cross-sectional view taken along line 4—4 of FIG. 2.

Referring also to FIG. 4, a pair of intake valves 51B and a pair of exhaust valves 52B each are disposed in each of the cylinders in the second cylinder head 19B of the second bank 23B. The intake valves 51B and the exhaust valves 52B are disposed in the second cylinder head 19B by being capable of opening and closing, while being spring-urged in a valve closing direction. Intake side cams 55B of an intake side camshaft 56B are rotatable about an axis that runs in parallel with the crankshaft 16 and are arranged to make a sliding contact with intake valve side lifters 53B in abutment with heads of corresponding ones of intake valves 51B. Exhaust side cams 57B of an exhaust side camshaft 58B are rotatable about an axis that runs in parallel with the crankshaft 16 and are arranged to make a sliding contact with exhaust valve side lifters 54B in abutment with heads of corresponding ones of exhaust valves 52B.

Figure 5:
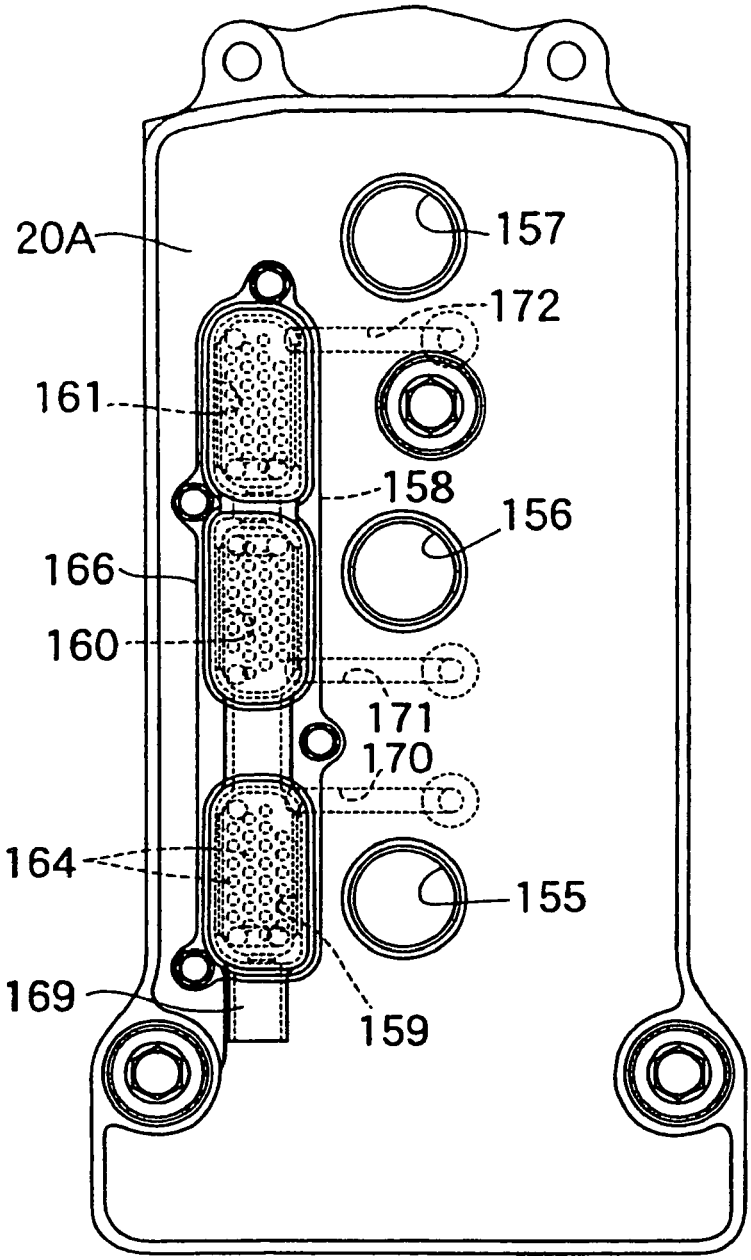
FIG. 5 is a view on arrow 5 of FIG. 1.

Referring to FIG. 5, the first head cover 20A of the first bank 23A includes three equally spaced plug insertion holes 155, 156, 157 provided from right to left in that order looking forward in the direction of travel of the motorcycle. Each of these plug insertion holes 155, 156, 157 is located at a position corresponding to a center of each cylinder, through which ignition plugs, not shown, are to be passed. In addition, the first head cover 20A also includes a mounting tubular portion 158 integrally provided in a projecting condition. The mounting tubular portion 158 is located, in a top surface of the first head cover 20A, rearward of the plug insertion holes 155, 156, 157. Further, the mounting tubular portion 158 has a cross-section that is long in the direction of arrangement of the plug insertion holes 155, 156, 157. The mounting tubular portion 158 is further provided with three mounting recesses 159, 160, 161 located from right to left in that order looking forward in the direction of travel of the motorcycle. The mounting recesses 159, 160, 161 form partition walls 158*a*, 158*b* between each pair of the mounting recesses 159, 160, 161. The partition walls 158*a*, 158*b* have a top surface flush with a top surface of a side wall of the mounting tubular portion 158.

The mounting recesses 159 and 160 of the mounting recesses 159, 160, 161 are disposed at positions substantially corresponding to the plug insertion holes 155 and 156, respectively, on one the hand. The mounting recess 161 is, on the other hand, disposed at a position substantially corresponding to a middle portion between the plug insertion holes 156 and 157. More specifically, the distance between the mounting recess 160 disposed in a middle of the mounting recesses 159, 160, 161 and the mounting recess 159 disposed to the right thereof is set to be greater than the distance between the mounting recess 160 disposed in the middle and the mounting recess 161 disposed to the left thereof. The mounting recesses 160, 161 are thus disposed in mutually close vicinity to each other.

An annular supporting member 163, mounted with a reed valve 162, is press-fitted into each of these mounting recesses 159, 160, 161. In addition, a protective member 165 formed into a bottomed cylinder having a plurality of small holes 164 (see FIG. 5) is press-fitted into each of these mounting recesses 159, 160, 161 so as to be disposed inwardly of the reed valve 162.

A cap 166 is joined to the mounting tubular portion 158 so as to cover the mounting tubular portion 158 from above. Referring to FIG. 2, the cap 166 includes partition walls 166*a*, 166*b* that abut on the partition walls 158*a*, 158*b* of the mounting tubular portion 158 from above. The partition walls 166*a*, 166*b* include concentric communication holes 167, 168. Further, a connection tubular portion 169 extending coaxially with the communication holes 167, 168 is integrally provided in a projecting condition for the cap 166. A conduit (not shown) for introducing secondary air is connected to this connection tubular portion 169. That is, secondary air is introduced between the cap 166 and the mounting tubular portion 158.

The first head cover 20A also includes secondary air paths 170, 171, 172 that are open to closed end inner surfaces of the mounting recesses 159 to 161. The secondary air paths 170 and 171 are disposed between the plug insertion holes 155 and 156. The secondary air path 172 is disposed between the plug insertion holes 156 and 157.

Referring to FIG. 3, the first cylinder head 19A includes secondary air paths 173 opening to lower end portions of the corresponding ones of the exhaust ports 152 of the cylinders and extending upwardly. An upper end of each of these secondary air paths 173 communicates with each of the secondary air paths 170, 171, 172 of the first head cover 20A via a corresponding one of connection pipes 174. The connection pipes 174, functioning as positioning pins, are clamped between the first head cover 20A and the first cylinder head 19A.

According to this secondary air supply structure on the side of the first bank 23A, the mounting tubular portion 158 disposed in the first head cover 20A and the cap 166 mounted to the mounting tubular portion 158 can be built even more compactly.

In the second bank 23B, the following arrangements are made to supply the two cylinders on the side of the second bank 23B with secondary air. More specifically, referring to FIG. 1, the second head cover 20B includes a mounting tubular portion 175 provided thereon in a projecting condition and a cap 176 is mounted on the mounting tubular portion 175. Accordingly, though the mounting tubular portion 158 and the cap 166 on the side of the first bank 23A are shaped differently from the mounting tubular portion 175 and the cap 176 on the side of the second bank 23B, the second bank 23B shares the same arrangement of the reed valves and the same structure for introducing the secondary air from the reed valve to the exhaust port as the first bank 23A.

Referring again to FIG. 4, intake side and exhaust side driven sprockets 59A, 60A are secured to one end of the intake side and exhaust side camshafts 56A, 58A, respectively, in the first bank 23A. Similarly, intake side and exhaust side driven sprockets 59B, 60B are secured to one end of the intake side and exhaust side camshafts 56B, 58B, respectively, in the second bank 23B.

A first bank side drive sprocket 61A and a second bank side drive sprocket 61B, rotating around an axis that runs in parallel with the crankshaft 16, are disposed outwardly of a right side wall in the crankcase 17 and upwardly of one end of the crankshaft 16. An endless cam chain 62A is wound around the intake side and exhaust side driven sprockets 59A, 60A on the side of the first bank 23A and the first bank side drive sprocket 61A. A chain path 63A for running the cam chain 62A is formed in the first cylinder block 18A, the first cylinder head 19A, and the first head cover 20A of the first bank 23A on one side of the crankshaft 16. Similarly, an endless cam chain 62B is wound around the intake side and exhaust side driven sprockets 59B, 60B on the side of the second bank 23B and the second bank side drive sprocket 61B. A chain path 63B for running the cam chain 62B is formed in the second cylinder block 18B, the second cylinder head 19B, and the second head cover 20B of the second bank 23B on one side of the crankshaft 16.

Figure 6:
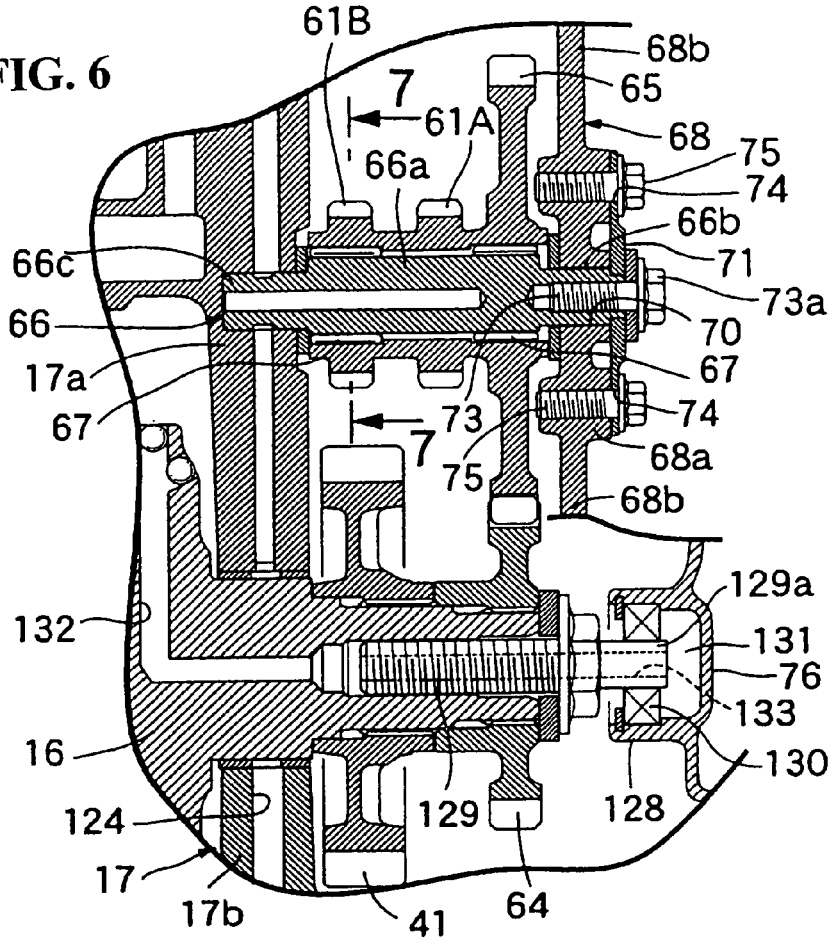
FIG. 6 is an enlarged view showing a principal part of FIG. 2.

Referring also to FIG. 6, an idler drive gear 64 formed to have a diameter smaller than the diameter of the primary drive gear 41 is disposed on one end of the crankshaft 16. More specifically, the idler drive gear 64 is disposed axially outwardly of the primary drive gear 41 such that an outer periphery thereof opposes the clutch 34 inserted between the crankshaft 16 and the gear transmission 30. An idle gear 65, in mesh with the idler drive gear 64, is rotatably supported on an idle shaft 66 having an axis that runs parallel with the crankshaft 16. In addition, the first bank side drive sprocket 61A and the second bank side drive sprocket 61B are provided in a connected row arrangement with, and coaxially on an axially inward side of, the idle gear 65 such that at least part of an outer periphery of the first bank side drive sprocket 61A and the second bank side drive sprocket 61B opposes the primary drive gear 41.

The first bank side drive sprocket 61A and the second bank side drive sprocket 61B are integrally formed with a single part that is common thereto, that is, the idle gear 65. The intake side and exhaust side driven sprockets 59A, 60A, the first bank side drive sprocket 61A, and the cam chain 62A, and the intake side and exhaust side driven sprockets 59B, 60B, the second bank side drive sprocket 61B and the cam chain 62B are all disposed mutually adjacently on one side axially of the crankshaft 16. The intake side and exhaust side driven sprockets 59A, 60A are secured to the intake side and exhaust side camshafts 56A, 58A on the side of the first bank 23A so as to drive the intake side and exhaust side camshafts 56A, 58A. The intake side and exhaust side driven sprockets 59B, 60B are secured to the intake side and exhaust side camshafts 56B, 58B on the side of the second bank 23B so as to drive the intake side and exhaust side camshafts 56B, 58B.

Figure 7:
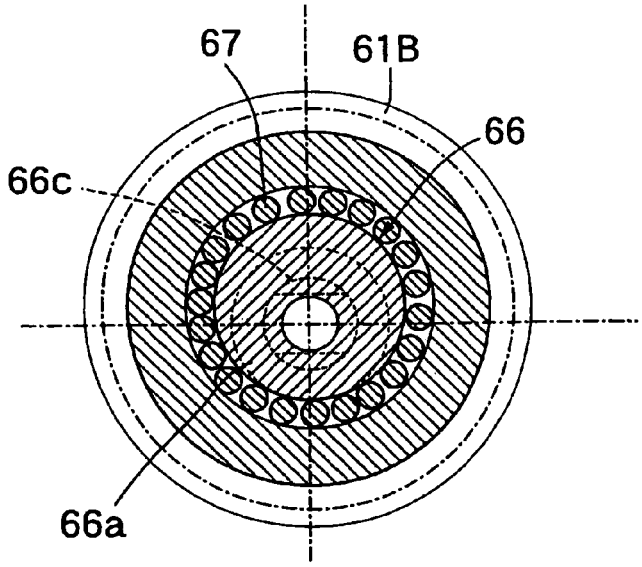
FIG. 7 is an enlarged cross-sectional view taken along line 7—7 of FIG. 6.

Referring to FIG. 7, the idle shaft 66 includes integrally an eccentric shaft portion 66*a* and shaft support portions 66*b*, 66*c*. More specifically, the eccentric shaft portion 66*a* forms a central portion of the idle shaft 66. The shaft support portions 66*b*, 66*c* are extended from the idle shaft 66 in corresponding directions, having a single axis offset from an axis of the idle shaft 66. The idle gear 65, the first bank side drive sprocket 61A, and the second bank side drive sprocket 61B are rotatably supported on the eccentric shaft portion 66*a* via a pair of needle bearings 67, 67.

It should be noted herein that the idle shaft 66 is supported by the crankcase 17 by being capable of rotating about the axis of the shaft support portions 66*b*, 66*c*, that is, the axis offset from the axis of the eccentric shaft portion 66*a*. The shaft support portion 66*b* on one end of the idle shaft 66 is rotatably supported by a shaft holder 68 joined to the right side wall of the crankcase 17 when looking forward in the direction of travel of the motorcycle. Further, the shaft support portion 66*c* on the other end of the idle shaft 66 is rotatably supported by the right side wall of the crankcase 17 when looking forward in the direction of travel of the motorcycle.

Figure 8:
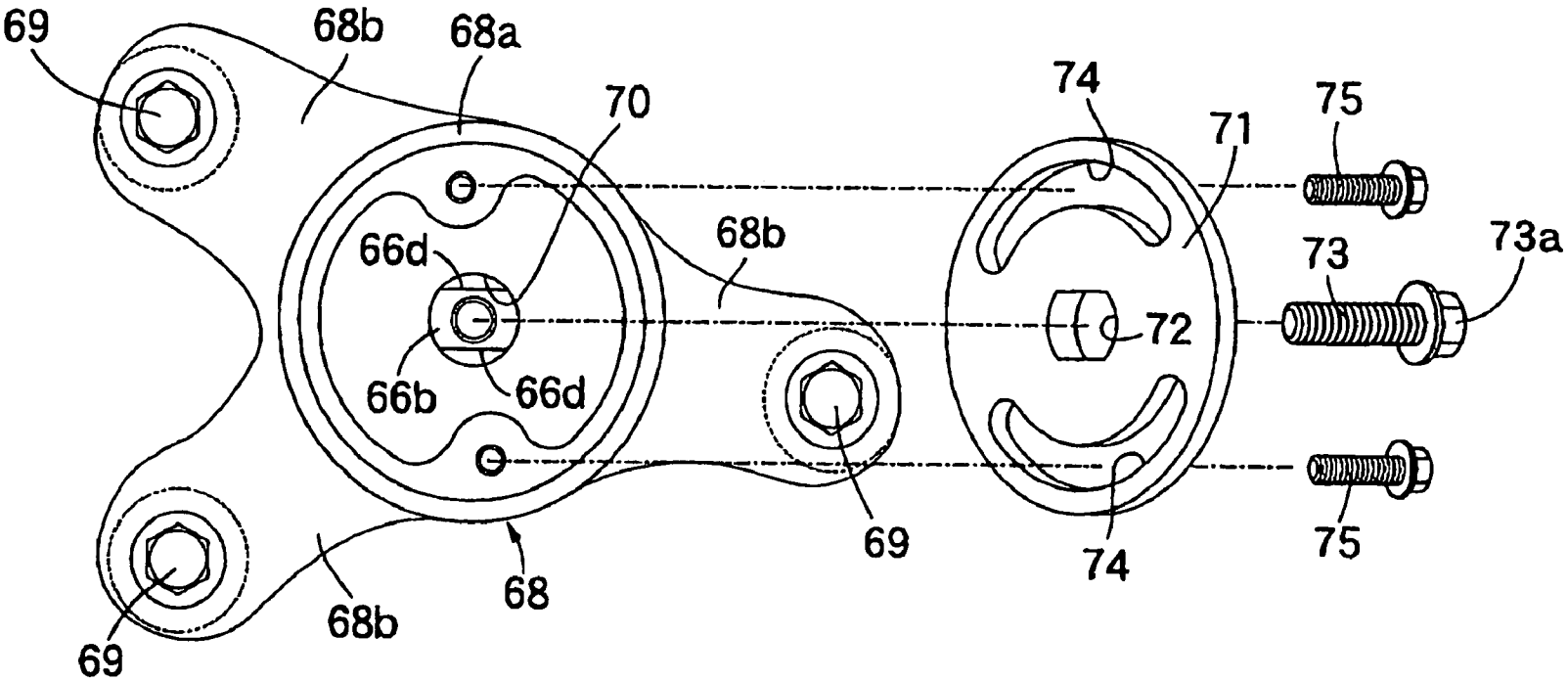
FIG. 8 is an exploded perspective view showing a shaft holder and a restriction plate.

Referring to FIG. 8, the shaft holder 68 integrally includes a support portion 68*a* and support arm portions 68*b*. The support portion 68*a* is disk-shaped. The support arm portions 68*b* project outwardly from the support portion 68*a* at a plurality of circumferential locations, for example, at three locations. A leading end portion of each of these support arm portions 68*b* is secured to the right side wall of the crankcase 17 by a corresponding one of bolts 69 at locations that will not impede travel of the cam chains 62A, 62B. The support portion 68*a* includes a circular support hole 70 disposed at a center thereof. The shaft support portion 66*b* on one end of the idle shaft 66 is rotatably fitted in, and supported by, the support hole 70. Further, a leading end portion of the shaft support portion 66*b* on the one end of the idle shaft 66 is formed to have a noncircular cross-section so as to have, for example, on an outer periphery thereof a pair of flat surfaces 66*d* that run in parallel with each other.

A circular restriction plate 71 is disposed outwardly of the support portion 68*a* in the shaft holder 68. The restriction plate 71 includes a restriction hole 72 disposed at a center thereof. The restriction hole 72 receives the leading end portion of the shaft support portion 66*b* fitted therein so as to disable relative rotation. The restriction hole 72 is shaped to correspond to a cross-sectional shape of the leading end portion of the shaft support portion 66*b*. A bolt 73 is screwed into the shaft support portion 66*b* such that an enlarged-diameter head portion 73*a* is engaged with the restriction plate 71. The restriction plate 71 is thereby secured to the shaft support portion 66*b*.

The restriction plate 71 also includes slots 74, 74 disposed at, for example, two locations surrounding the restriction hole 72. The slots 74, 74 are circularly arcuate about an axis of the shaft support portion 66*b*. Bolts 75, 75 that pass through these slots 74, 74 are screwed to the support portion 68*a* of the shaft holder 68.

Accordingly, when the bolts 75 are tightened, the idle shaft 66 is prevented from rotating about the axis of the shaft support portions 66*b*, 66*c*. When the bolts 75 are loosened, the idle shaft 66 is then permitted to rotate about the shaft support portions 66*b*, 66*c*, namely, about the axis offset from the axis of the eccentric shaft portion 66*a*.

A cover 76 is connected to the right side wall of the crankcase 17 so as to continue to the first cylinder block 18A and the second cylinder block 18B of the first bank 23A and the second bank 23B, respectively. The cover 76 covers not only the clutch 34, but also one end of the crankshaft 16 and the shaft holder 68.

Referring to FIG. 4, the first bank side drive sprocket 61A and the second bank side drive sprocket 61B are to rotate in the direction shown by an arrow 77. On the side of the first bank 23A, the cam chain 62A is arranged to have a tension side and a slack side as follows. More specifically, a portion of the cam chain 62A between the first bank side drive sprocket 61A and the exhaust side driven sprocket 60A is the slack side. This portion corresponds to an outside of the first bank 23A and the second bank 23B. A portion of the cam chain 62A between the intake side driven sprocket 59A and the first bank side drive sprocket 61A is the tense side. This portion corresponds to an inside of the first bank 23A and the second bank 23B. On the side of the second bank 23B, on the other hand, the cam chain 62B is arranged to have a tension side and a slack side as follows. More specifically, a portion of the cam chain 62B between the second bank side drive sprocket 61B and the exhaust side driven sprocket 60B is the slack side. This portion corresponds to the outside of the first bank 23A and the second bank 23B. A portion of the cam chain 62B between the intake side driven sprocket 59B and the second bank side drive sprocket 61B is the tense side. This portion corresponds to the inside of the first bank 23A and the second bank 23B.

Accordingly, the crankcase 17 further includes a chain guide member 80A, a chain tensioner 81A, a chain guide member 80B, and a chain tensioner 81B mounted thereon. The chain guide member 80A is in contact with an outer periphery of the cam chain 62A on the side of the first bank 23A on the tense side thereof. The chain tensioner 81A is in contact with an outer periphery of the cam chain 62A on the side of the first bank 23A on the slack side thereof. The chain guide member 80B is in contact with an outer periphery of the cam chain 62B on the side of the second bank 23B on the tense side thereof. The chain tensioner 81B is in contact with an outer periphery of the cam chain 62B on the side of the second bank 23B on the slack side thereof.

One end of the chain guide members 80A, 80B are disposed, one on top of another, at a position obliquely downwardly of, and near, the first bank side and the second bank side drive sprockets 61A, 61B. The one end of the chain guide members 80A, 80B are clamped between one of the three support arm portions 68*b* of the shaft holder 68 for supporting the idle shaft 66 and the crankcase 17. One of the bolts 69 for joining the three support arm portions 68*b* to the crankcase 17 is passed through the one end of the chain guide members 80A, 80B that are placed one on top of another. Upper portions of the chain guide members 80A, 80B are abutted against, and supported by, an inner wall of the first and the second cylinder heads 19A, 19B in the first and the second banks 23A, 23B.

The chain tensioner 81A on the side of the first bank 23A is formed into an arch such that a project surface thereof makes a sliding contact with the outer periphery of the cam chain 62A on the slack side thereof at a portion corresponding to the outside of the first and the second banks 23A, 23B. The chain tensioner 81B on the side of the second bank 23B is formed into an arch such that a project surface thereof makes a sliding contact with the outer periphery of the cam chain 62B on the slack side thereof at a portion corresponding to the inside of the first and the second banks 23A, 23B. One end of the chain tensioners 81A, 81B on the side of the crankshaft 16 are rotatably supported on the crankcase 17 via pivots 82A, 82B.

Tensioner lifters 83A, 83B abut against the chain tensioners 81A, 81B of the first and the second banks 23A, 23B from a side opposite to the cam chains 62A, 62B in order to give tension to the cam chains 62A, 62B on the slack side. The tensioner lifters 83A, 83B are disposed on the cylinder heads 19A, 19B of the first and the second banks 23A, 23B, respectively.

More specifically, the tensioner lifter 83A of the first bank 23A is disposed on the first cylinder head 19A at a portion corresponding to the outside of the first and the second banks 23A, 23B. The tensioner lifter 83B of the second bank 23B is disposed on the second cylinder head 19B at a portion corresponding to the inside of the first and the second banks 23A, 23B.

The tensioner lifters 83A, 83B are of well known design including cylindrical cases 84A, 84B and push rods 85A, 85B. The push rods 85A, 85B project from one end of the cases 84A, 84B and are urged in a projecting direction. The cases 84A, 84B are fitted in mounting holes 87A, 87B included in the first and the second cylinder heads 19A, 19B such that leading ends of the push rods 85A, 85B contact the outer peripheries of the cam chains 62A, 62B. Flanges 86A, 86B, projecting radially outwardly from a middle portion of the cases 84A, 84B, are then joined to the first and the second cylinder heads 19A, 19B.

Moreover, a distance LA between the upper end connection surface 22A of the first cylinder head 19A on the side of the first bank 23A and the tensioner lifter 83A is set to be smaller than a distance LB between the upper end connection surface 22B of the second cylinder head 19B on the side of the second bank 23B and the tensioner lifter 83B.

A portion of the tensioner lifter 83B projecting from the second cylinder head 19B of the second bank 23B is disposed to be inclined so as to be closer to the upper end connection surface 22B of the second cylinder head 19B toward an outward end. A portion of the tensioner lifter 83A projecting from the first cylinder head 19A of the first bank 23A is disposed to be inclined so as to be farther away from the upper end connection surface 22A of the first cylinder head 19A toward an outward end.

Referring to FIGS. 9 through 12, a pump unit 93 is disposed on an underside of the transmission chamber 27. The pump unit 93 includes a feed pump 91 and a scavenging pump 92, both having a common oil pump shaft 90. A pump housing 94 of the pump unit 93 is mounted to the barrier rib 28 disposed in the crankcase 17 from below.

The pump housing 94 includes a housing main body 95 and first and second covers 96, 97. The first and the second covers 96, 97 sandwich the housing main body 95 from both sides and are clamped together by a plurality of bolts 98. A mounting portion 95*a*, integrated with the housing main body 95 and extending upwardly, is joined to the barrier rib 28 and the oil pump shaft 90 rotatably passes through the pump housing 94. A pump driven sprocket 99 is secured to one end of the oil pump shaft 90. As shown in FIG. 2, an endless chain 101 is wound around the pump driven sprocket 99 and a pump drive sprocket 100 that is supported on the outside of the crankcase 17 by the main shaft 31 so as to be rotated with the primary driven gear 42. Accordingly, the feed pump 91 and the scavenging pump 92 are driven through power drive transmission from the crankshaft 16.

Both the feed pump 91 and the scavenging pump 92 are trochoid pumps. The feed pump 91 includes an inner rotor 102 secured to the oil pump shaft 90 and an outer rotor 103 in mesh with the inner rotor 102. The inner rotor 102 and the outer rotor 103 are housed in a space between the housing main body 95 and the first cover 96. Similarly, the scavenging pump 92 includes an inner rotor 104 secured to the oil pump shaft 90 and an outer rotor 105 in mesh with the inner rotor 104. The inner rotor 104 and the outer rotor 105 are housed in a space between the housing main body 95 and the second cover 97.

The first cover 96 in the pump housing 94 includes an intake path 106 for drawing oil into the feed pump 91. At least an upstream portion of the intake path 106 is formed to extend vertically and an upstream end of the intake path 106 is open to a lower end of the first cover 96 so as to be open downwardly.

The feed pump 91 pumps up oil from the oil pan 25 through an oil strainer 107 disposed inside the oil pan 25. The oil strainer 107 is connected to the intake path 106. A casing 108 of the oil strainer 107 is formed by a pair of upper and lower members joined to each other. The casing 108 includes a casing main portion 108*a*, a connection pipe portion 108*b*, and a suction pipe portion 108*c*. The casing main portion 108*a* is flatly shaped. The connection pipe portion 108*b* extends upwardly from the casing main portion 108*a*. The suction pipe portion 108*c* extends downwardly gradually tapering downwardly and includes a suction port 110 formed on a lower end thereof. The casing 108 has a funnel-shaped lower portion.

An upper end portion of the connection pipe portion 108*b* is fitted in the upstream end of the intake path 106 via an annular sealing member 109. The upper end portion of the casing 108 is supported by the first cover 96 of the pump housing 94 mounted to the barrier rib 28 of the crankcase 17. More specifically, the lower portion of the casing 108 whose upper end portion is supported by the crankcase 17 via the pump housing 94 is formed into the funnel shape including the suction port 110 formed on the lower end thereof.

Figure 10:
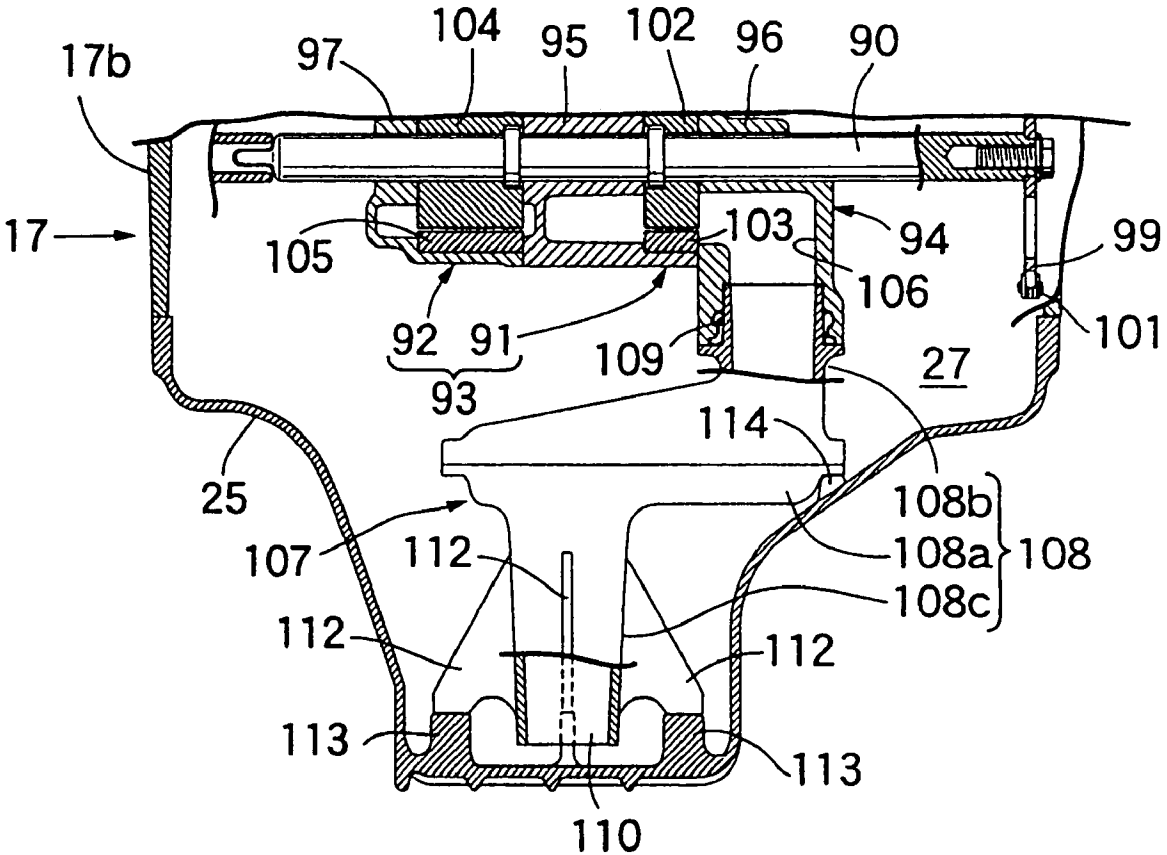
FIG. 10 is an enlarged cross-sectional view taken along line 10—10 of FIG. 1.

Referring to FIG. 10, the oil pan 25 is formed into substantially a V-shape with a narrowed lower portion as viewed from the rear looking forward in the direction of travel of the motorcycle. The casing 108 of the oil strainer 107 is formed as follows as viewed from the rear looking forward in the direction of travel of the motorcycle. More specifically, the casing main portion 108*a* and the connection pipe portion 108*b* are disposed closer to a right side wall of the oil pan 25, while the suction pipe portion 108*c* is disposed substantially at the center in a lateral direction of the oil pan 25.

A plurality of strainer support portions 112, 112 is integrally formed with a side surface of the suction pipe portion 108*c* in the lower portion of the casing 108. Each of these, for example, four strainer support portions 112, 112 is a vertically long sheet form having a greater amount of projection toward a lower end of the casing 108. Each of these strainer support portions 112, 112 is abutted against a corresponding one of the support projections 113, 113 disposed in a projected condition on a bottom portion of the oil pan 25.

The strainer support portions 112, 112 are disposed at the front and rear of the suction pipe portion 108*c* as well as on the right and left of the suction pipe portion 108*c* so as to run orthogonally relative to the direction of travel of the motorcycle.

The right side wall of the oil pan 25 includes a support projection 114 that is integrally formed thereon in a projecting condition. The support projection 114 abuts against a right lower portion of the casing main portion 108*a* in the casing 108.

Figure 11:
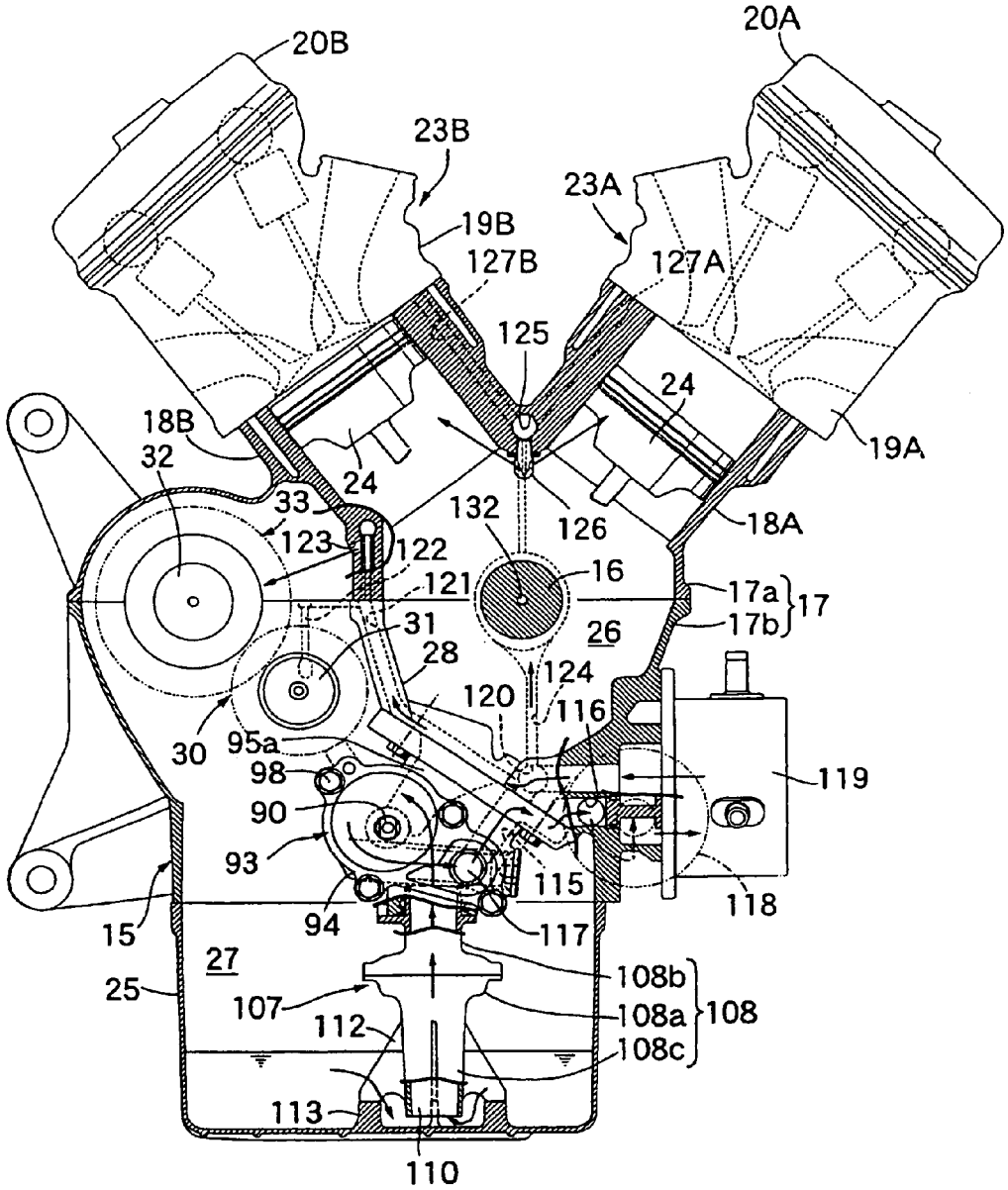
FIG. 11 is a longitudinal cross-sectional view showing an engine main body as viewed from the same direction as FIG. 1, indicating the flow of oil by a feed pump.
Figure 12:
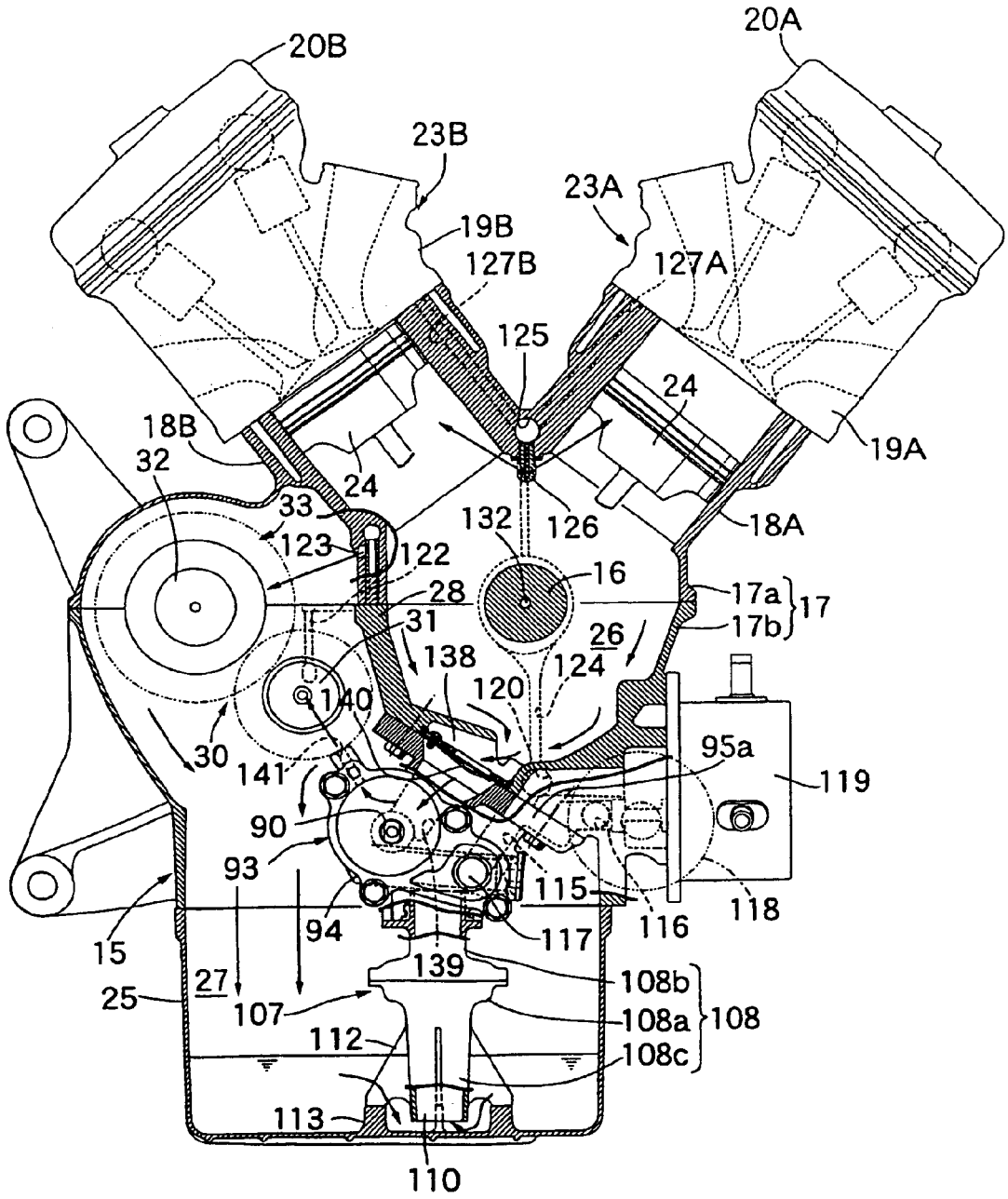
FIG. 12 is a longitudinal cross-sectional view showing the engine main body corresponding to FIG. 11, indicating the flow of oil by a scavenging pump.

Referring to FIGS. 11 and 12, the housing main body 95 in the pump housing 94 includes a delivery path 115 for delivering oil from the feed pump 91. The delivery path 115 is in communicat with an oil path 116 disposed in the barrier rib 28 of the crankcase 17. In addition, a relief valve 117 is mounted between the housing main body 95 of the pump housing 94 and the first cover 96. The relief valve 117 has an axis that runs in parallel with the oil pump shaft 90. The relief valve 117 is mounted so as to open to allow part of the oil circulating through the delivery path 115 to escape toward an intake side of the feed pump 91 when a delivery pressure of the delivery path 115 becomes equal to, or more than, a predetermined value.

Oil circulating through the oil path 116 disposed in the barrier rib 28 flows past, and is thus purified by, an oil filter 118 mounted in the crankcase 17 before being guide to and cooled by an oil cooler 119 mounted in the crankcase 17 as shown by an arrow in FIG. 11.

The barrier rib 28 includes a main gallery 120 extending in parallel with the crankshaft 16. The oil guided from the oil cooler 119 to the main gallery 120 is branched into two paths. Oil branched to one path is guided to an oil path 121 disposed in the barrier rib 28. The oil then flows through an oil path 122 before being supplied to a shaft support portion of the gear train 33 to the main shaft 31 and to the countershaft 32 in the gear transmission 30. The oil is also injected toward the gear transmission 30 from a nozzle 123 disposed in the crankcase 17 so as to face an upper portion of the transmission chamber 27.

Oil branched from the main gallery 12 to the other path is sent upwardly by way of a plurality of oil paths 124 disposed in the crankcase 17 and used for lubrication of a plurality of bearing portions supporting the crankshaft 16. The oil paths 124 are in communication with an upper portion oil gallery 125 that is disposed at an upper portion of the crankcase 17 so as to extend in parallel with the crankshaft 16 at a connection between the two banks 23A, 23B. The oil branched to the other path is then injected toward the pistons 24 of the cylinders in the two banks 23A, 23B from nozzles 126 connected to the upper portion oil gallery 125. The cylinder blocks 18A, 18B and the cylinder heads 19A, 19B of the first and the second banks 23A, 23B include oil paths 127A, 127B for guiding the oil from the upper portion oil gallery 125 toward a valve train disposed between the cylinder heads 19A, 19B and the head covers 20A, 20B.

As clearly indicated in FIG. 6, a tubular portion 128 projecting toward the side of the crankshaft 16 is integrally formed on an inner surface of the right cover 76 at a portion corresponding to one end of the crankshaft 16. A bolt 129 having a cylindrical portion 129*a* advancing into an inside of the tubular portion 128 is screwed coaxially to the one end of the crankshaft 16. There is disposed between the tubular portion 128 and the cylindrical portion 129*a* an annular sealing member 130. An oil chamber 131 sealed by the sealing member 130 is formed so as to face an end portion of the cylindrical portion 129*a* inside the tubular portion 128. The oil chamber 131 is supplied with oil from the main gallery 120 by way of an oil path not shown in the drawing.

The bolt 129 includes a communication path 133 formed therein coaxially. The communication path 133 brings an internal oil path 132 that is included inside the crankshaft 16 into communication with the oil chamber 131. Oil guided into the internal oil path 132 is used for lubrication between the crankpins 16*a* the crankshaft 16 and the big ends of the connecting rods 29.

Referring specifically to FIG. 12, the barrier rib 28 includes an oil collecting hole 138 for collecting oil fallen down onto a lower portion inside the crank chamber 26. The oil collecting hole 138 is disposed at a lower portion of the barrier rib 28 so as to provide communication with a lower portion of the crank chamber 26. The crank chamber 26 is partitioned into the following sections. More specifically, a section in the first and the second banks 23A, 23B corresponding to the cylinders on one end in the direction of cylinder arrangement, a section in the first and the second banks 23A, 23B corresponding to the cylinders on the other end in the direction of cylinder arrangement and a section in the first bank 23A corresponding to the center cylinder in the direction of cylinder arrangement. The oil collecting hole 138 is disposed at the lower portion of the barrier rib 28 for each of these sections of the crank chamber 26 that are mutually partitioned from each other. The housing main body 95 having the mounting portion 95*a* integrated therewith and mounted to the barrier rib 28 in the pump housing 94 includes an intake path 139 for drawing oil into the scavenging pump 92. The intake path 139 is provided so as to correspond to the oil collecting hole 138.

In addition, a reed valve 140 is disposed between the oil collecting hole 138 communicating with the portion corresponding to the central cylinder in the direction of cylinder arrangement of the first bank 23A and the intake path 139 disposed in the housing main body 95. The reed valve 140 allows oil to circulate only from the oil collecting hole 138 to the intake path 139.

The second cover 97 in the pump housing 94 includes a delivery path 141 for guiding oil delivered from the scavenging pump 92. The delivery path 141 is formed in the second cover 97 so as to deliver oil toward the side of the gear transmission 30 from a downstream end thereof.

Figure 9:
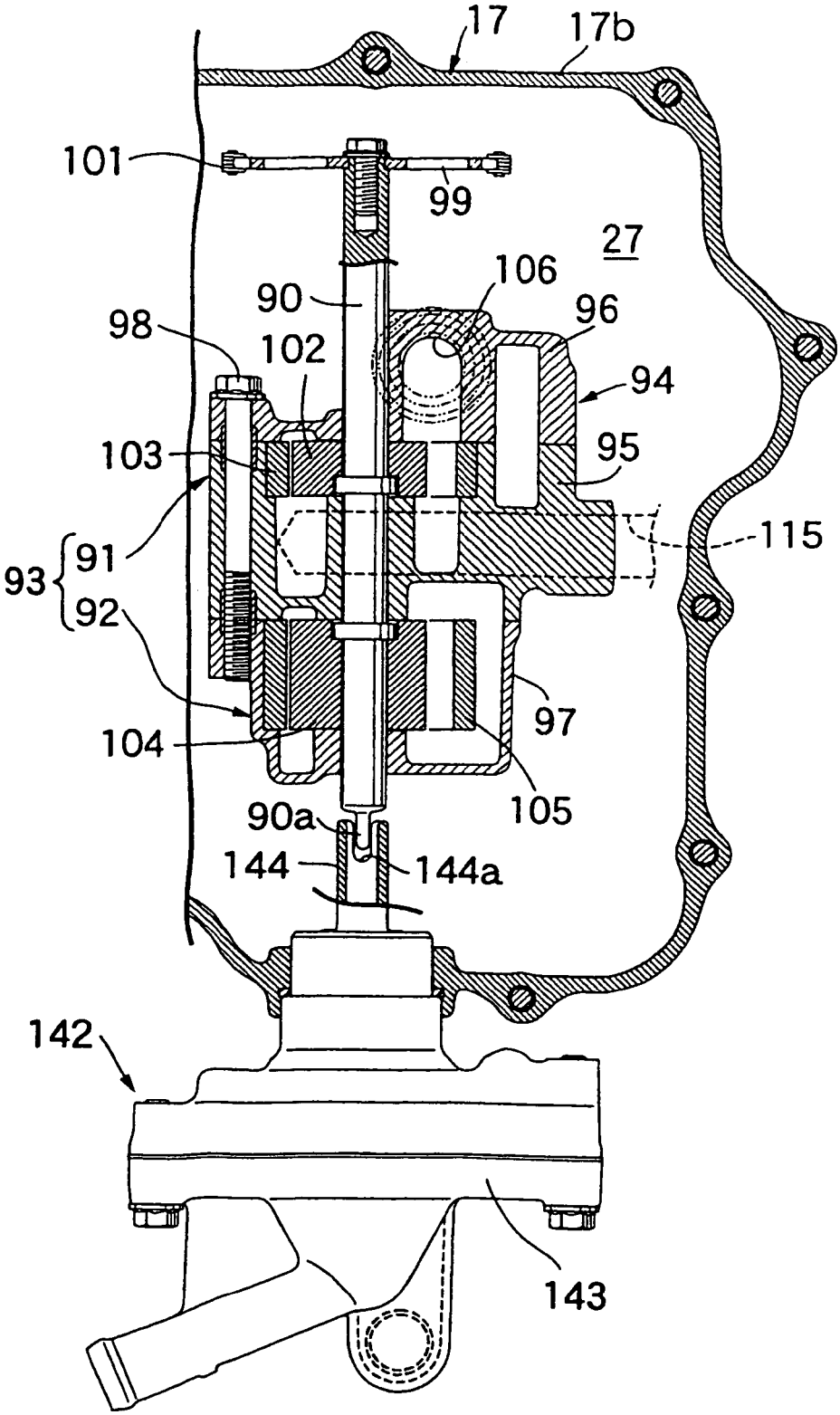
FIG. 9 is an enlarged cross-sectional view taken along line 9—9 of FIG. 1.

Referring specifically to FIG. 9, a pump case 143 of a water pump 142 is mounted on the left side wall of the crankcase 17 at a part corresponding to the pump unit 93. A water pump shaft 144 of the water pump 142 projecting from one end of the pump case 143 is disposed coaxially with the oil pump shaft 90 of the pump unit 93. A projection 90*a* provided in a projected condition on a proximal end of the oil pump shaft 90 is engaged disengageably with an engagement recess 144*a* disposed on the one end of the water pump shaft 144. That is, as the feed pump 91 and the scavenging pump 92 in the pump unit 93 are driven through power drive transmission from the crankshaft 16, so is the water pump 142 driven through power drive transmission from the crankshaft 16.

In operation, the preferred embodiment of the present invention will be described below. The intake side camshaft 56A and the exhaust side camshaft 58A for driving to open or close the intake valves 51A and the exhaust valves 52A in the first bank 23A include the intake side driven sprocket 59A and the exhaust side driven sprocket 60A, respectively. The endless cam chain 62A is wound around the first bank side drive sprocket 61A that is rotated with the idle gear 65, to which power drive is transmitted from the crankshaft 16, and the intake side and the exhaust side camshafts 56A, 58A. The intake side camshaft 56B and the exhaust side camshaft 58B for driving to open or close the intake valves 51B and the exhaust valves 52B in the second bank 23B include the intake side driven sprocket 59B and the exhaust side driven sprocket 60B, respectively. The endless cam chain 62B is wound around the second bank side drive sprocket 61B that is rotated with the idle gear 65 and the intake side and the exhaust side camshafts 56B, 58B. The crankshaft 16 is mounted with the primary drive gear 41 that transmits engine power drive to the side of the gear transmission 30 and the idler drive gear 64 that is formed to have a diameter smaller than the diameter of the primary drive gear 41 and disposed axially outwardly from the primary drive gear 41. The idle gear 65 in mesh with the idler drive gear 64 is rotatably supported on the idle shaft 66 that has an axis running in parallel with the crankshaft 16 and is supported by the crankcase 17 of the engine main body 15. The first bank side drive sprocket 61A and the second bank side drive sprocket 61B are provided in a connected row arrangement with, and coaxially on the axially inward side of, the idle gear 65 such that at least part of the outer periphery of the first bank side drive sprocket 61A and the second bank side drive sprocket 61B opposes the primary drive gear 41.

More specifically, the idle gear 65 is made to be in mesh with the idler drive gear 64 disposed on the crankshaft 16 and having a diameter smaller than the primary drive gear 41 that has a relatively large diameter. Further, the first bank side and the second bank side drive sprockets 61A, 61B are provided in a connected row arrangement with, and coaxially on the axially inward side of, the idle gear 65 such that at least part of the outer periphery of the first bank side and the second bank side drive sprockets 61A, 61B opposes the primary drive gear 41. This helps to reduce the distance between the crankshaft 16 and the idle shaft 66, thereby contributing to a compactly built V-engine. The primary driven gear 42 meshed with the primary drive gear 41 is connected to the clutch 34 disposed at a position opposing an outer periphery of the idler drive gear 64 and interposed between the crankshaft 16 and the gear transmission 30. This allows the crankshaft 16 and the clutch 34 to be disposed in close vicinity to each other, thereby reducing the distance between the axis of the clutch 34 and the crankshaft 16. This contributes to an even more compactly built V-engine.

The first bank side drive sprocket 61A, the intake side driven sprocket 59A, the exhaust side driven sprocket 60A, and the cam chain 62A on the side of the first bank 23A, and the second bank side drive sprocket 61B, the intake side driven sprocket 59B, the exhaust side driven sprocket 60B, and the cam chain 62B on the side of the second bank 23B that forms a V with the first bank 23A are disposed mutually adjacently on one axially side of the crankshaft 16. The first bank side drive sprocket 61A and the second bank side drive sprocket 61B are formed integrally with the single idle gear 65 that is common to the two drive sprockets 61A, 61B. These arrangements contribute to a compactly built V-engine in the direction of the axis of the crankshaft 16. Moreover, the arrangements also contribute to a reduced number of engine parts.

Further, the idle shaft 66 having the eccentric shaft portion 66*a* is supported on the crankcase 17 such that the position of the idle shaft 66 is adjustable about the axis offset from the axis of the eccentric shaft portion 66*a*. The idle gear 65 is rotatably supported on the eccentric shaft portion 66*a* via the pair of needle bearings 67. This arrangement allows a backlash between the idler drive gear 64 and the idle gear 65 to be reduced by adjusting a rotational axis of the idle gear 65. In addition, the arrangement prevents the first bank side and the second bank side drive sprockets 61A, 61B and the idle gear 65 from becoming large in diameter and thereby makes the axial distance between the idle shaft 66 and the crankshaft 16 even smaller.

It is arranged in the first and the second banks 23A, 23B that the tensioner lifters 83A, 83B abut against the chain tensioners 81A, 81B that make a sliding contact with the cam chains 62A, 62B from the side opposite to the cam chains 62A, 62B in order to give tension to the cam chains 62A, 62B. These tensioner lifters 83A, 83B are disposed on the cylinder heads 19A, 19B of the first and the second banks 23A, 23B, respectively. Of the two tensioner lifters 83A, 83B, the tensioner lifter 83A of the first bank 23A disposed, according to the preferred embodiment of the present invention, forwardly in the direction of travel of the motorcycle is disposed on the first cylinder head 19A at a portion corresponding to the outside of the first and the second banks 23A, 23B. The other tensioner lifter 83B is disposed on the second cylinder head 19B at a portion corresponding to the inside of the first and the second banks 23A, 23B. Further, the distance LA between the upper end connection surface 22A of the first cylinder head 19A and the tensioner lifter 83A is set to be smaller than the distance LB between the upper end connection surface 22B of the second cylinder head 19B and the other tensioner lifter 83B.

Accordingly, the other tensioner lifter 83B disposed on the second cylinder head 19B at the portion corresponding to the inside of the first and the second banks 23A, 23B can be disposed at a level as low as possible, thereby minimizing a dead space between the two banks 23A, 23B as much as possible.

Further, the portion of the other tensioner lifter 83B projecting from the second cylinder head 19B is disposed to be inclined so as to be closer to the upper end connection surface 22B of the second cylinder head 19B. This arrangement allows the dead space between the two banks 23A, 23B to be made even smaller. The arrangement also facilitates mounting of the tensioner lifter 83B onto the second cylinder head 19B from above, thus enhancing the mountability.

The portion of the tensioner lifter 83A projecting from the first cylinder head 19A is disposed to be inclined so as to be farther away from the upper end connection surface 22A of the first cylinder head 19A. The arrangement suppresses the projection of the tensioner lifter 83A disposed on the outside of the two banks 23A, 23B from the first cylinder head 19A, thereby contributing to a compactly built engine. At the same time, the arrangement can secure a space for placing auxiliaries disposed around the engine.

There is disposed on the lower portion of the crankcase 17 the oil pan 25 for accumulating oil to be supplied to different parts of the engine main body 15. The upper end portion of the casing 108 of the oil strainer 107 disposed inside the oil pan 25 is supported on the side of the crankcase 17. The suction port 110 is formed on the lower end casing 108 that has a funnel-shaped lower portion. The plurality of strainer support portions 112, each being a vertically long sheet form, is integrally formed with the side surface in the lower portion of the casing 108 of the oil strainer 107. Each of these strainer support portions 112 is abutted against, and supported on, the bottom portion of the oil pan 25.

Accordingly, the strength of the lower portion of the casing 108 can be enhanced by making each of the strainer support portions 112 function as a reinforcement rib. In addition, the support strength of the oil strainer 107 can be enhanced without having to enhance the support strength on the side of the crankcase 17 that supports the upper end portion of the oil strainer 107. The oil strainer 107 can therefore be rigidly supported, while avoiding an increase in the size and weight of the engine and the number of parts used therein. Further, each of these strainer support portions 112 also functions as a partition wall for restricting movement of oil within the oil pan 25. This eliminates the need for disposing the partition walls in the oil pan 25 other than the oil strainer 107. This again contributes to using a reduced number of parts.

Each of the strainer support portions 112 is formed to project more from the casing 108 toward a lower end thereof. Accordingly, the flow of oil near the suction port 110 can be effectively rectified and suction resistance of oil to the suction port 110 can be held at a minimum. Thus, suction efficiency can be enhanced.

A pair each of the strainer support portions 112 is disposed in the fore-aft direction and the right-to-left direction of the motorcycle, respectively. Movement of oil inside the oil pan 25 involved with a sudden acceleration or sudden deceleration of the motorcycle, and movement of oil inside the oil pan 25 involved with lateral motion of the motorcycle can be effectively restricted by the strainer support portions 112.

Furthermore, the oil pan 25 is formed into substantially a V-shape with a narrowed lower portion as viewed from the direction of travel of the motorcycle. This effectively prevents oil from moving in the fore-aft direction during sudden acceleration or sudden deceleration of the motorcycle between the right and left side walls of the oil pan 25 shaped substantially into a V with a narrowed lower portion and the oil strainer 107.

While the present invention has been described in connection with the preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a V-engine having an arrangement, in which cylinder heads of first and second banks set at an angle to each other so as to form the letter V are provided in a connected row arrangement on a crankcase that rotatably supports a crankshaft, with camshafts being rotatably supported on corresponding ones of the two banks, first and second chain tensioners are provided so as to be in a sliding contact with a corresponding one of cam chains that transmit power from the crankshaft to corresponding ones of the camshafts, and the cylinder heads of the two banks include first and second tensioner lifters for abutting on a corresponding one of the first and second chain tensioners from a side opposite to the cam chains for providing tension to each of the cam chains, a structure for mounting a tensioner lifter, comprising:

said first tensioner lifter of the two tensioner lifters being disposed on the cylinder head of the first bank at a portion corresponding to an outside of the first and the second banks;

said second tensioner lifter of the two tensioner lifters being disposed on the cylinder head of the second bank at a portion corresponding to the inside of the first bank and the second bank; and a distance between an upper end connection surface of the cylinder head of the first bank and the first tensioner lifter is set to be smaller than a distance between an upper end connection surface of the cylinder head of the second bank and the second tensioner lifter.

2. The structure for mounting the tensioner lifter for the V-engine according to claim 1, wherein a portion of the second tensioner lifter projecting from the cylinder head of the second bank is disposed to be inclined so as to be closer to the upper end connection surface of the cylinder head toward an outward end.

3. The structure for mounting the tensioner lifter for the V-engine according to claim 2, wherein a portion of the first tensioner lifter projecting from the cylinder head of the first bank is disposed to be inclined so as to be farther away from the upper end connection surface of the cylinder head toward an outward end.

4. The structure for mounting the tensioner lifter for the V-engine according to claim 1, wherein a portion of the first tensioner lifter projecting from the cylinder head of the first bank is disposed to be inclined so as to be farther away from the upper end connection surface of the cylinder head toward an outward end.

5. The structure for mounting the tensioner lifter for the V-engine according to claim 1, wherein the first and second tensioner lifters are disposed on a slack side of the cam chains.

6. The structure for mounting the tensioner lifter for the V-engine according to claim 1, and further including a chain guide member operatively positioned relative to a tense side of the cam chains.

7. The structure for mounting the tensioner lifter for the V-engine according to claim 1, wherein the first tensioner lifter is formed in an arch having a projecting surface for making sliding contact with an outer periphery of the cam chain on a slack side thereof.

8. The structure for mounting the tensioner lifter for the V-engine according to claim 7, and further including a pivot point wherein one end of said first tensioner lifter is rotatably mounted on said pivot point.

9. The structure for mounting the tensioner lifter for the V-engine according to claim 1, wherein the second tensioner lifter is formed in an arch having a projecting surface for making sliding contact with an outer periphery of the cam chain on a slack side thereof.

10. The structure for mounting the tensioner lifter for the V-engine according to claim 9, and further including a pivot point wherein one end of said second tensioner lifter is rotatably mounted on said pivot point.

11. A chain tensioner for use in a V-engine having cylinder heads of first and second banks set at an angle to each other so as to form the letter V being provided in a connected row arrangement on a crankcase that rotatably supports a crankshaft, with camshafts being rotatably supported on corresponding ones of the two banks comprising:

a first chain tensioner being in sliding contact with a corresponding first cam chain for transmitting power from the crankshaft to corresponding ones of the camshafts, and the cylinder heads of the two banks;

a first tensioner lifter for abutting on said first chain tensioner from a side opposite to the cam chains for providing tension to said first cam chain;

a second chain tensioner being in sliding contact with a corresponding second cam chain for transmitting power from the crankshaft to corresponding ones of the camshafts, and the cylinder heads of the two banks;

a second tensioner lifter for abutting on said second chain tensioner from a side opposite to the cam chains for providing tension to said second cam chain;

said first tensioner lifter being disposed on the cylinder head of the first bank at a portion corresponding to an outside of the first and the second banks;

said second tensioner lifter being disposed on the cylinder head of the second bank at a portion corresponding to the inside of the first bank and the second bank; and a distance between an upper end connection surface of the cylinder head of the first bank and the first tensioner lifter is set to be smaller than a distance between an upper end connection surface of the cylinder head of the second bank and the second tensioner lifter.

12. The chain tensioner for use in a V-engine according to claim 11, wherein a portion of the second tensioner lifter projecting from the cylinder head of the second bank is disposed to be inclined so as to be closer to the upper end connection surface of the cylinder head toward an outward end.

13. The chain tensioner for use in a V-engine according to claim 12, wherein a portion of the first tensioner lifter projecting from the cylinder head of the first bank is disposed to be inclined so as to be farther away from the upper end connection surface of the cylinder head toward an outward end.

14. The chain tensioner for use in a V-engine according to claim 11, wherein a portion of the first tensioner lifter projecting from the cylinder head of the first bank is disposed to be inclined so as to be farther away from the upper end connection surface of the cylinder head toward an outward end.

15. The chain tensioner for use in a V-engine according to claim 11, wherein the first and second tensioner lifters are disposed on a slack side of the first and second cam chains.

16. The chain tensioner for use in a V-engine according to claim 11, and further including a chain guide member operatively positioned relative to a tense side of the first and second cam chains.

17. The chain tensioner for use in a V-engine according to claim 11, wherein the first tensioner lifter is formed in an arch having a projecting surface for making sliding contact with an outer periphery of the first cam chain on a slack side thereof.

18. The chain tensioner for use in a V-engine according to claim 17, and further including a pivot point wherein one end of said first tensioner lifter is rotatably mounted on said pivot point.

19. The chain tensioner for use in a V-engine according to claim 11, wherein the second tensioner lifter is formed in an arch having a projecting surface for making sliding contact with an outer periphery of the second cam chain on a slack side thereof.

20. The chain tensioner for use in a V-engine according to claim 19, and further including a pivot point wherein one end of said second tensioner lifter is rotatably mounted on said pivot point.

* * * * *